US008192006B2

(12) United States Patent
Koseki

(10) Patent No.: US 8,192,006 B2
(45) Date of Patent: Jun. 5, 2012

(54) LIQUID-JET HEAD CHIP, LIQUID-JET HEAD, AND LIQUID-JET RECORDING APPARATUS

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 361 days.

(21) Appl. No.: 12/592,867

(22) Filed: Dec. 3, 2009

(65) Prior Publication Data

US 2010/0141721 A1 Jun. 10, 2010

(30) Foreign Application Priority Data

Dec. 8, 2008 (JP) ..... 2008-312368

(51) Int. Cl.
*B41J 2/19* (2006.01)

(52) U.S. Cl. ..... 347/92

(58) Field of Classification Search ..... 347/54, 347/65, 66, 68, 92
See application file for complete search history.

(56) References Cited

U.S. PATENT DOCUMENTS

| | | | | |
|---|---|---|---|---|
| 5,030,973 | A * | 7/1991 | Nonoyama et al. | 347/93 |
| 5,394,181 | A * | 2/1995 | Braun | 347/92 |
| 6,592,214 | B2 * | 7/2003 | Shimosato | 347/92 |
| 6,811,247 | B2 * | 11/2004 | Tominaga et al. | 347/54 |
| 7,604,337 | B2 * | 10/2009 | Koseki | 347/92 |
| 2008/0036822 | A1 | 2/2008 | Oya | 347/68 |

FOREIGN PATENT DOCUMENTS

| | | |
|---|---|---|
| EP | 1302323 | 4/2003 |
| JP | 01306257 | 12/1989 |
| JP | 2007030495 | 2/2007 |
| WO | 01 60627 | 8/2001 |

* cited by examiner

*Primary Examiner* — Anh T. N. Vo
(74) *Attorney, Agent, or Firm* — Adams & Wilks

(57) ABSTRACT

To simplify a head-chip is provided with an actuator including grooves and a cover plate bonded onto the one surface of the actuator and including an opening portion including an ink chamber having an aperture plane being open on an upper end surface and slits extending from the ink chamber to be in communication with the grooves, and an flow path for bringing the upper end surface and one end surface extending in a thickness direction into communication with each other, the opening portion and the flow path being provided independently of each other. In the head-chip, foreign substance removal filter for removing a foreign substance is provided at a position at which the aperture plane of the ink chamber is substantially closed, and a filter for allowing passage of air bubbles, is provided at a position at which an opening of the flow path is substantially closed.

10 Claims, 4 Drawing Sheets

LIQUID-JET HEAD CHIP, LIQUID-JET HEAD, AND LIQUID-JET RECORDING APPARATUS

BACKGROUND OF THE INVENTION

1. Field of the Invention

The present invention relates to a liquid-jet head chip, a liquid-jet head, and a liquid-jet recording apparatus.

2. Description of the Related Art

A liquid-jet recording apparatus, which uses a liquid-jet head having a plurality of discharge nozzles for discharging a liquid such as an ink therefrom to record characters or images on a recording medium, is conventionally known. In general, an ink-jet head includes an actuator substrate, a cover plate substrate, and an ink flow path member. The actuator substrate includes a plurality of discharge grooves. The cover plate substrate forms an ink path. The ink flow path member includes a common liquid chamber for supplying the ink to each of the discharge grooves through the cover plate substrate. The ink-jet head is formed by bonding the actuator substrate, the cover plate substrate, and the ink flow path member to each other in a laminated manner in a thickness direction (for example, see JP 2007-30495 A; hereinafter, referred to as "Patent Document 1").

In the conventional ink-jet head, when a foreign substance removal filter is provided in a liquid supply chamber of the ink flow path member, the amount of ink supply to the common liquid chamber tends to become insufficient due to air bubbles which are too large to pass through the foreign substance removal filter. To cope with such a problem, the ink-jet head described in Patent Document 1 includes an air-bubble exhaust path formed in the ink flow path member. Through the air-bubble exhaust path, air bubbles accumulated at the upstream of the foreign substance removal filter are exhausted to the exterior. At the same time, a negative-pressure retention filter is provided in the air-bubble exhaust path to retain a negative pressure in the ink flow path member.

However, when the negative-pressure retention filter is provided in the ink flow path member or in an additional separate component outside the ink-jet head as in the case of the conventional ink-jet head, there is a problem in that a shape of the ink flow path member becomes complicated or the number of components is increased. There is another problem in that the size of the ink-jet head cannot be reduced, thereby disadvantageously increasing manufacturing cost.

SUMMARY OF THE INVENTION

The present invention has been made in view of the circumstances described above, and has an object of providing a liquid-jet head chip, a liquid-jet head, and a liquid-jet recording apparatus, each having a simple structure without requiring an additional separate component.

In order to achieve the object described above, the present invention provides the following means.

The present invention provides a liquid-jet head chip, including:

an actuator substrate comprising a plurality of liquid discharge flow paths, the plurality of liquid discharge flow paths each being open on one surface of the actuator substrate, the plurality of liquid discharge flow paths being formed in parallel at a distance from each other;

a cover plate substrate bonded onto the one surface of the actuator substrate;

the cover plate substrate including:

an opening portion being open on a surface of the cover plate substrate on a side opposite to the actuator substrate and being in communication with the liquid discharge flow paths; and an air vent flow path for bringing the surface on which the opening portion is open and an end surface extending in a thickness direction of the cover plate substrate into communication with each other, the opening portion and the air vent flow path being provided independently of each other;

a foreign substance removal filter for removing a foreign substance provided at a position at which the opening portion of the cover plate substrate is substantially closed; and a filter for allowing passage of air bubbles, having a smaller passage resistance than that of the foreign substance removal filter, provided at a position at which an opening of the air vent flow path is substantially closed.

According to the present invention, when a liquid is stored in the opening portion provided to the cover plate substrate, the opening portion functions as a common liquid chamber for supplying the liquid to each of the liquid discharge flow paths. Moreover, side walls of each of the liquid discharge flow paths are subjected to shear deformation to change a volume of each of the liquid discharge flow paths. As a result, the liquid distributed from the opening portion to the liquid discharge flow paths can be discharged from each of the liquid discharge flow paths. Moreover, by arranging the foreign substance removal filter in the opening portion, dirt and dust contained in the liquid to be supplied to the liquid discharge flow paths can be removed, while large air bubbles can be prevented from entering the liquid discharge flow paths.

In this case, the air vent flow path for bringing the surface of the cover plate substrate, on which the opening portion is open (hereinafter, the surface is referred to as "upper end surface"), and the end surface of the cover plate substrate into communication with each other is formed independently of the opening portion. As a result, when a flow path member is bonded onto the upper end surface of the cover plate substrate to supply the liquid to the opening portion, the air bubbles, which are too large to pass through the foreign substance removal filter, can be expelled through the air vent flow path to the exterior. In this manner, the foreign substance removal filter can be prevented from being blocked by the air bubbles. Accordingly, the supply of the liquid to the opening portion can be prevented from being disrupted.

Moreover, the filter for allowing passage of air bubbles, which has a smaller passage resistance than that of the foreign substance removal filter, is provided in the air vent flow path. As a result, a negative pressure in the opening portion can be maintained by a surface tension of the liquid while the air bubbles are allowed to pass through the filter for allowing passage of air bubbles. As a result, the liquid can be prevented from leaking from the air vent flow path. Moreover, by providing the foreign substance removal filter and the air vent flow path to the cover plate substrate, an additional separate component is not required to simplify a structure of the liquid-jet head chip.

In the above-mentioned invention, the opening portion may include: a concave portion having an aperture plane on the surface on the side opposite to the actuator substrate; and a plurality of through-holes extending from the concave portion to the liquid discharge flow paths.

With the configuration as described above, the liquid supplied from the aperture plane of the concave portion passes through the through-holes to be distributed to the liquid discharge flow paths. Therefore, for example, by arranging one through-hole for every two liquid discharge flow paths, the liquid-jet head chip for water-based ink can be configured.

In the above-mentioned invention, the air vent flow path may be open in a direction along the liquid discharge flow paths.

By setting the direction in which the liquid is discharged from the liquid discharge flow paths and the direction in which the air vent flow path is open to be in communication with the exterior to the same, an air-bubble exhaust hole can be formed on a nozzle plate through which nozzle holes are to be formed. As a result, the structure of the liquid-jet head chip can be further simplified.

The present invention provides a liquid-jet head including: the liquid-jet head chip according to the present invention described above; and a flow path member bonded onto the surface of the cover plate substrate, on which the opening portion is open, the flow path member including a flow path being in communication with the opening portion and the air vent flow path.

According to the present invention, the liquid can be supplied to the opening portion without allowing the large air bubbles to be accumulated on the foreign substance removal filter of the cover plate substrate. Moreover, it is unnecessary to provide the foreign substance removal filter or the air vent flow path to the flow path member, and hence the shape of the liquid-jet head can be simplified. As a result, the entire size of the liquid-jet head can be reduced.

The present invention provides a liquid-jet recording apparatus including the liquid-jet head according to the present invention described above.

According to the present invention, the liquid can be stably discharged. For example, when an ink is used as the liquid, stable printing can be performed on the recording medium.

According to the present invention, it is possible to provide the effects of simplifying the structure without requiring a complicated shape or an additional separate component.

DETAILED DESCRIPTION OF THE PREFERRED EMBODIMENTS

Hereinafter, a liquid-jet head chip 1, a liquid-jet head 10, and a liquid-jet recording apparatus 100 according to an embodiment of the present invention are described referring to the accompanying drawings.

Figure 1:
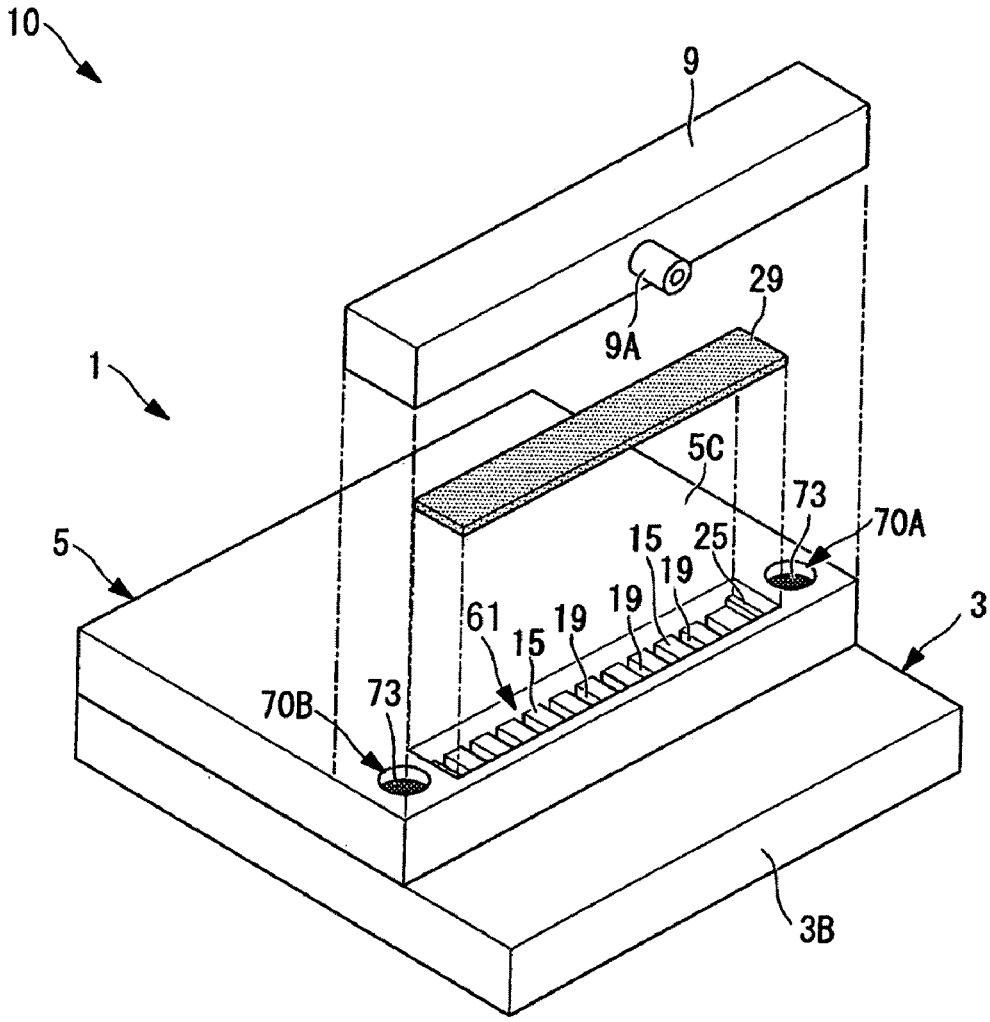
FIG. 1 is an exploded perspective view of a liquid-jet head according to an embodiment of the present invention.
Figure 2:
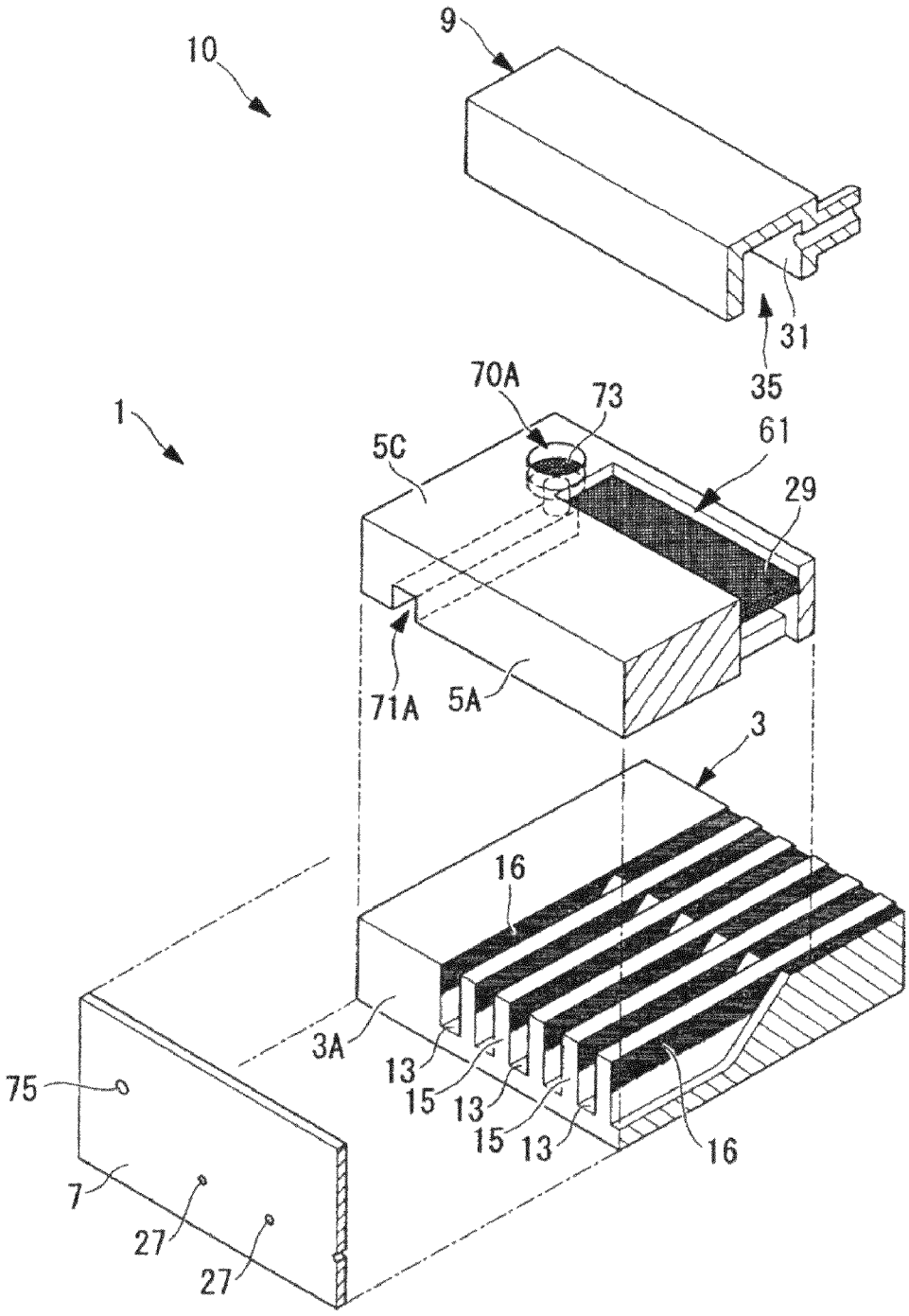
FIG. 2 is a perspective view illustrating a liquid-jet head chip illustrated in FIG. 1 in a further exploded manner.

The liquid-jet head 10 according to this embodiment discharges, for example, a water-based ink (liquid). As illustrated in FIGS. 1 and 2, the liquid-jet head 10 includes a liquid-jet head chip 1, a flow path (flow path member) 9 for supplying the ink to the liquid-jet head chip 1, and a wiring board (not shown) on which a drive circuit for driving the liquid-jet head chip 1 and the like is mounted. Each of the members described above is fixed onto a support plate (not shown) made of, for example, aluminum. The members are connected to each other through an adhesive, a double-faced adhesive tape, or the like, which has good thermal conductivity.

The liquid-jet head chip 1 includes an actuator substrate 3, a cover plate substrate 5, and a nozzle plate 7. The actuator substrate 3 having a thickness of about 0.8 mm is constituted by a piezoelectric element made of lead zirconate titanate (PZT) or the like. The cover plate substrate 5 having a thickness of about 0.8 mm is bonded onto one of the surfaces of the actuator substrate 3. The nozzle plate 7 is bonded onto an end surface of the actuator substrate 3 and an end surface of the cover plate substrate 5.

Figure 3:
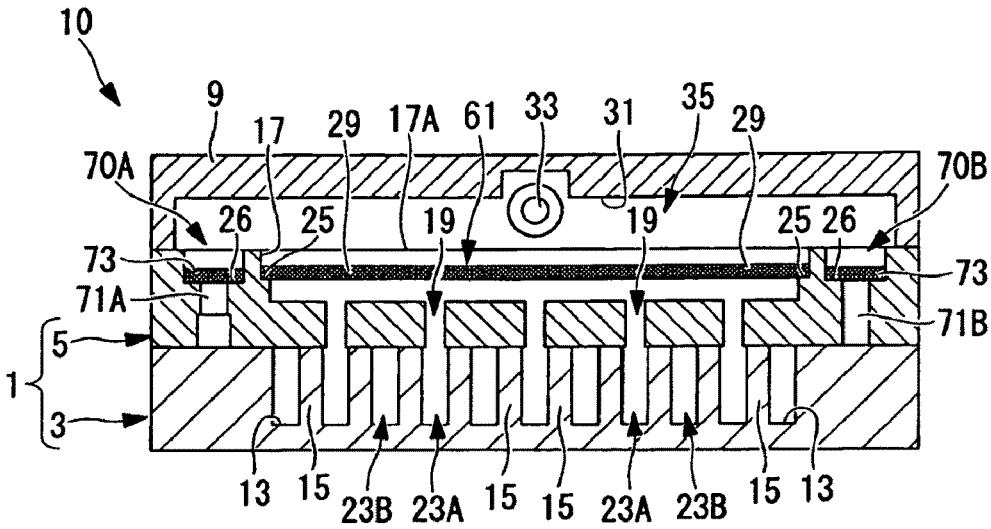
FIG. 3 is a sectional view of the liquid-jet head illustrated in FIG. 1.
Figure 4:
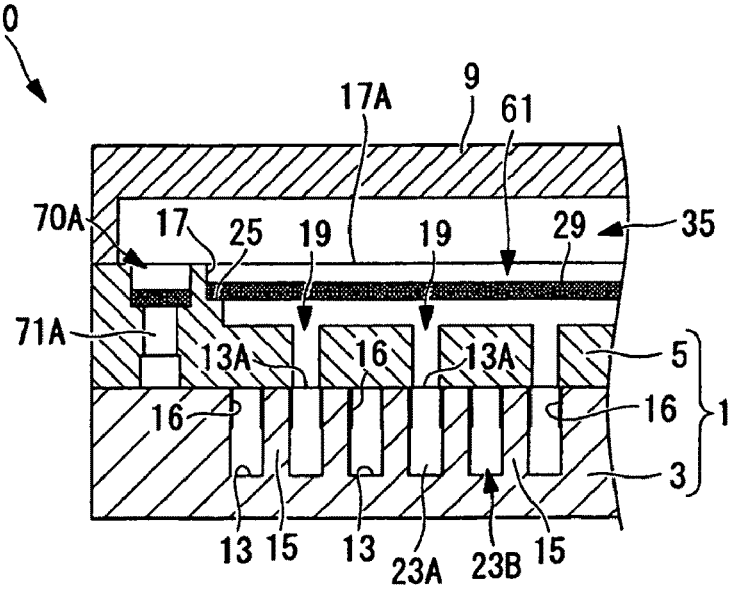
FIG. 4 is an enlarged sectional view of the liquid-jet head illustrated in FIG. 3.

The actuator substrate 3 is polarized in a thickness direction. As illustrated in FIGS. 3 and 4, a plurality of discharge grooves (liquid discharge flow paths) 13, each having an opening portion 13A in one of the surfaces of the actuator substrate 3 on which the cover plate substrate 5 is provided, are arranged in parallel at a distance from each other. Each of the discharge grooves 13 has a depth of, for example, about 0.36 mm. The discharge grooves 13 are separated from each other by side walls 15.

One longitudinal end of each of the discharge grooves 13 extends to one end surface 3A of the actuator substrate 3, whereas each of the discharge grooves 13 starts gradually decreasing its depth in the middle to have a reduced depth at the other longitudinal end. Each of such discharge grooves 13 is shaped according to, for example, an outer diameter of a blade of a disc-like die cutter (not shown).

Moreover, electrodes 16 for applying a driving voltage are formed by vapor deposition on both the side walls 15 of each of the discharge grooves 13 to extend in a longitudinal direction of the actuator substrate 3. The electrodes 16 are formed from the opening portion 13A of each of the discharge grooves 13 to the middle in a depth direction of the discharge groove 13.

The cover plate substrate 5 is bonded onto one surface of the actuator substrate 3, that is, onto the surface of the actuator substrate 3, on which the opening portions 13A of the discharge grooves 13 are formed. The cover plate substrate 5 includes a cover plate opening portion (opening portion) 61 constituted by a concave-shaped common ink chamber (concave portion) 17 and a plurality of slits (through-holes) 19. The common ink chamber (concave portion) 17 has an aperture plane 17A on a surface 5C of the cover plate substrate 5, which is on the side opposite to the actuator substrate 3. (Hereinafter, the surface 5C is referred to as an "upper end surface" 5C.) The plurality of slits 19 extend from the common ink chamber 17 to be brought into communication with the ends of some of the discharge grooves 13 of the actuator substrate 3, each having the reduced depth.

The common ink chamber 17 extends along a direction in which the discharge grooves 13 of the actuator substrate 3 are arranged. In this manner, the common ink chamber 17 has a communication structure which is opposed to the ends of all the discharge grooves 13. In a state where the cover plate substrate 5 is bonded onto the actuator substrate 3, an area other than portions where the slits 19 extending from the common ink chamber 17 are in communication with some of the opening portions 13A of the discharge grooves 13 is closed by the cover plate substrate 5. As a result, a plurality of independent discharge channels 23A and dummy channels 23B are formed.

Each of the discharge channels 23A is an ink flow path constituted by the discharge groove 13 which is in communication with the slit 19 of the cover plate substrate 5. Each of the discharge channels 23A is filled with an ink supplied from the common ink chamber 17. Meanwhile, each of the dummy channels 23B is a cavity portion formed by closing the opening portion 13A of the discharge groove 13 with the cover plate substrate 5 and is sealed to prevent the ink from flowing thereinto. The discharge channels 23A and the dummy channels 23B are alternately formed in the direction in which the discharge grooves 13 are arranged.

The common ink chamber 17 is provided with step portions 25. Each of the step portions 25 is formed by inwardly projecting an inner wall surface in a direction away from the opening portion 17A. Each of the step portions 25 is formed at a distance of about 0.5 mm from the surface of the cover plate substrate 5, which is on the side of the actuator substrate 3. A foreign substance removal filter 29 having a flat surface is fixed to the step portions 25 by bonding while being located to substantially close the aperture plane 17A of the common ink chamber 17.

The foreign substance removable filter 29 has, for example, a mesh structure with a hole diameter of about eight microns and a thickness of about 0.1 mm. The foreign substance removable filter 29 is located at an approximately constant distance (about 0.5 mm) away from the ends of all the slits 19 on the actuator substrate 3 side. The foreign substance removal filter 29 is capable of removing dirt and dust contained in the ink supplied from the common ink chamber 17 to the discharge grooves 13 and prevent large air bubbles from entering the discharge grooves 13. Moreover, even when the liquid-jet head chip 1 alone is handled separately at the time of assembly of the liquid-jet head 10 or the like, the foreign substance removal filter 29 prevents the dust from entering the common ink chamber 17.

Two air vent flow paths 71A and 71B for bringing the upper end surface 5C and an end surface 5A extending in a thickness direction into communication with each other are provided to the cover plate substrate 5. The air vent flow paths 71A and 71B are provided for expelling air bubbles to the exterior, the air bubbles being accumulated on the foreign substance removable filter 29 provided in the common ink chamber 17, the air vent flow paths 71A and 71B being provided independently from the common ink chamber 17.

More specifically, the air vent flow path 71A has an inlet portion 70A at a position adjacent to one longitudinal end of the aperture plane 17A of the common ink chamber 17, whereas the air vent flow path 71B has an inlet portion 70B adjacent to the other longitudinal end of the aperture plane 17A. Each of the air vent flow paths 71A and 71B first extends in the thickness direction and is then bent in the middle in a direction along the discharge grooves 13 to be open on the end surface 5A of the cover plate substrate 5 which is provided approximately flush with the end surface 3A of the actuator substrate 3.

Each of the air vent flow paths 71A, and 71B is provided with a step portion 26. The step portion 26 is formed by inwardly projecting inner wall surfaces in a direction away from each of the inlet portions 70A and 70B. On the step portion 26 of each of the air vent flow paths 71A and 71B, a filter 73 for allowing passage of air bubbles, which has a smaller passage resistance than that of the foreign substance removal filter 29, that is, a larger hole diameter than that of the foreign substance removal filter 29, is arranged.

Each of the filters 73 for allowing passage of air bubbles has a mesh structure with a hole diameter of about twenty-five microns and a thickness of about 0.05 mm. Each of the filters 73 for allowing passage of air bubbles allows air bubbles to pass therethrough and also is capable of maintaining a negative pressure in the common ink chamber 17 by surface tension of the ink, which is formed by air entering from air-bubble exhaust holes 75 through the air vent flow paths 71A and 71B and a mesh filled with the ink.

The formation of the aperture plane 17A of the common ink chamber 17, the inlet portion 70A of the air vent flow path 71A, and the inlet portion 70B of the air vent flow path 71B on the same surface of the cover plate substrate 5 allows the foreign substance removal filter 19 and the filters 73 for allowing passage of air bubbles to be attached from the same direction. As a result, an operation process can be simplified.

The nozzle plate 7 is bonded to the end surface 3A of the actuator substrate 3, on which the discharge channels 23A and the dummy channels 23B are open, and the end surface 5A of the cover plate substrate 5, on which the two air vent flow paths 71A and 71B are open. The nozzle plate 7 has nozzle holes 27 and the air-bubble exhaust holes 75. The nozzle holes 27 are located to be opposed to the openings of the discharge channels 23A. The air-bubble exhaust holes 75 are located to be opposed to the openings of the air vent flow paths 71A and 71B. The openings of the dummy channels 23B are sealed by the nozzle plate 7.

The nozzle plate 7 is, for example, a polyimide film through which the nozzle holes 27 and the air-bubble exhaust holes 75 are formed by using an excimer laser device or the like. A water-repellent film (not shown) having water repellency is formed on a surface of the nozzle plate 7, which is to be opposed to the recording medium, thereby preventing the ink from adhering thereto.

The flow path 9 is bonded onto the upper end surface 5C of the cover plate substrate 5 so as to cover the aperture plane 17A of the common ink chamber 17, the inlet portion 70A of the air vent flow path 71A, and the inlet portion 70B of the air vent flow path 71B. The flow path 9 is connected through an intermediation of a connection portion 9A to a pressure-regulating chamber (not shown) for temporarily storing the ink supplied from an ink tank (not shown). The flow path 9 includes a flow path concave portion 31 which is open on a surface of the flow path 9 on the cover plate substrate 5 side and an ink introduction hole 33 provided on an inner wall surface of the flow path concave portion 31, to which the connection portion 9A is open to be opposed.

The flow path concave portion 31 extends along the longitudinal direction of the common ink chamber 17 of the actuator substrate 3 and forms an approximately rectangular parallelepiped common flow path 35 which is in communication with the common ink chamber and both of the air vent flow paths 71A and 71B.

The ink introduction hole 33 is provided for introducing the ink supplied from the pressure-regulating chamber to the common flow path 35 and is located in the vicinity of an approximate longitudinal center of the flow path concave portion 31.

The support plate supports the actuator substrate 3 and the cover plate substrate 5 which are overlapped with each other and also supports the nozzle plate 7. A fit hole extending in the direction in which the discharge grooves 13 are arranged is formed through the support plate. The support plate supports the actuator substrate 3 and the cover plate substrate 5 which are overlapped with each other while the actuator substrate 3 and the cover plate substrate 5 are being fitted into the fit hole. A surface of the support plate on the distal end side is flush with an end surface of each of the actuator substrate 3 and the cover plate substrate 5 on the distal end side.

Figure 5:
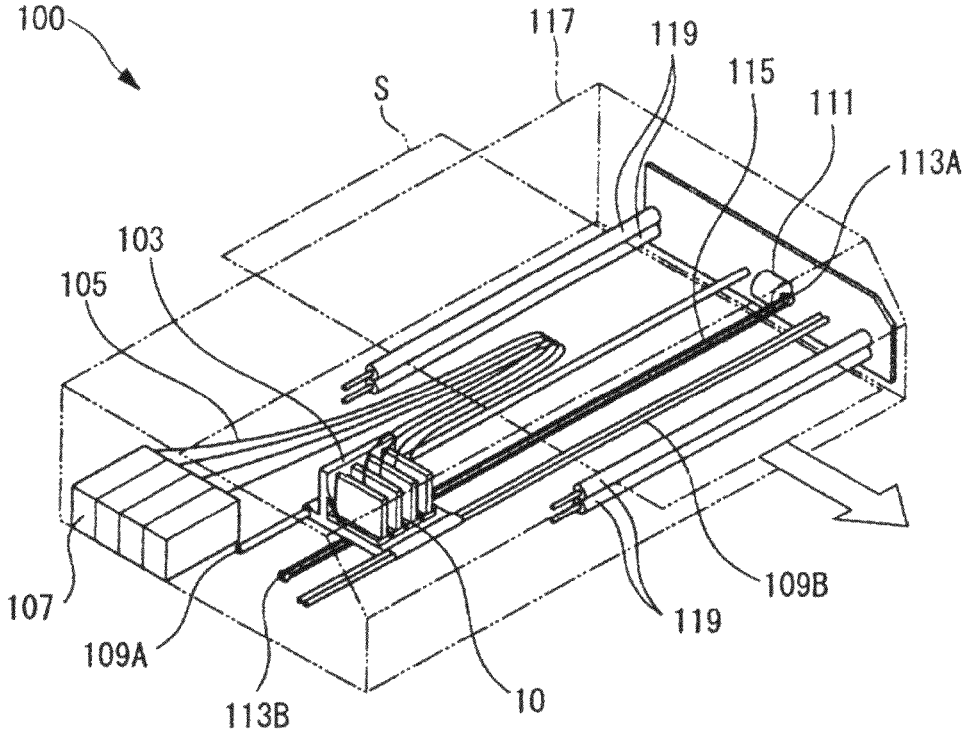
FIG. 5 is a schematic perspective view of a liquid-jet recording apparatus on which the liquid-jet head illustrated in FIG. 1 is mounted.

For use, the liquid-jet head 10 thus configured is mounted on the liquid-jet recording apparatus 100 which is an ink-jet recording apparatus used in a printer, a fax, or the like, as illustrated in FIG. 5.

The liquid-jet recording apparatus 100 includes a plurality of the liquid-jet heads 10, a carriage 103, and an ink cartridge 107. The plurality of liquid-jet heads 10 are respectively provided for different colors. The liquid-jet heads 10 are arranged in a main-scanning direction to be mounted onto the carriage 103. The ink cartridge 107 supplies the ink to the liquid-jet heads 10 through an ink supply tube 105 made of a flexible tube.

The carriage 103 is mounted to be movable in a long axis direction of a pair of guide rails 109A and 109B. A drive motor 111 is provided on the side of one end of the pair of the guide rails 109A and 109B. A drive force generated by the drive motor 111 is transmitted to a timing belt 115 bridged between a pulley 113A connected to the drive motor 111 and a pulley 113B provided on the side of the other end of the pair of the guide rails 109A and 109B. As a result, the carriage 103 fixed at a predetermined position on the timing belt 115 is conveyed.

A pair of conveying rollers 119 are provided along the guide rails 109A and 109B on the side of each end of a case 117 indicated by a dot line in a direction perpendicular to the direction in which the carriage 103 is conveyed. The pairs of conveying rollers 119 convey a recording medium S below the carriage 103 in a direction perpendicular to the direction in which the carriage 103 is conveyed.

In the liquid-jet recording apparatus 100 thus configured, the carriage 103 is scanned in a direction perpendicular to a direction in which the recording medium S is fed while the recording medium S is being fed by the conveying rollers 119. As a result, characters, images, and the like are recorded on the recording medium S by the liquid-jet heads 10.

Hereinafter, the functions of the liquid-jet heads 10 mounted on the liquid-jet recording apparatus 100 are specifically described.

After the ink supplied from the ink tank is temporarily stored in the pressure-regulating chamber, the ink passes through the connection portion 9A and the ink introduction hole 33 of the flow path 9 to be introduced into the common flow path 35. Then, the ink is guided into the common ink chamber 17 of the cover plate substrate 5.

In this case, the ink introduced through the ink introduction hole 33 flows from the vicinity of the approximate longitudinal center of the common flow path 35 and the common ink chamber 17 to spread toward both ends. Therefore, the air bubbles entering the common flow path 35 from the ink introduction hole 33 which are too large to pass through the foreign substance removal filter 29 of the common ink chamber 17 are likely to be accumulated in a direction away from the ink introduction hole 33, that is, at both longitudinal ends of the common flow paths 35.

The arrangement of the air vent flow paths 71A and 71B at both longitudinal ends of the aperture plane 17A of the common ink chamber 17 allows the air bubbles to be efficiently expelled to the exterior. As a result, the foreign substance removal filter 29 can be prevented from being blocked by the air bubbles, thereby preventing the supply of the ink to the common ink chamber 17 from being disrupted. Moreover, the maintenance of the negative pressure in the common ink chamber 17 by the surface tension of the ink with the filters 73 for allowing passage of air bubbles prevents the ink from leaking from the air vent flow paths 71A and 71B.

The ink, which has passed through the foreign substance removal filter 29 in the common ink chamber 17, is supplied to all the discharge channels 23A through the slits 19A in a distributed manner. The foreign substance removal filter 29 does not only prevent the large air bubbles from entering the discharge grooves 13 but also is capable of removing the dirt and dust and the like contained in the ink.

After the ink is supplied to each of the discharge channels 23, a voltage is applied to the electrodes 16 provided on the both side walls 15 of a predetermined one of the discharge channels 23A. As a result, the side walls 15 are deformed by a piezoelectric thickness-shear effect to change a volume of the corresponding discharge channel 23A.

For example, the voltage is applied in one direction perpendicular to the polarization direction to outwardly deform both the side walls 15 of the discharge channel 23A, that is, deform both the side walls 15 toward the dummy channel 23B. As a result, the amount of ink, which corresponds to an increase in volume of the discharge channel 23A, is introduced into the discharge channel 23A.

Subsequently, the voltage applied to the side walls 15 is set to zero. Specifically, both the side walls 15 of the discharge channel 23A are placed in a state without deformation before the application of the voltage. As a result, the volume of the discharge channel 23A is reduced to increase the pressure, thereby discharging the ink from each of the nozzle holes 27.

In this case, the foreign substance removal filter 29 having the flat surface is arranged in the common ink chamber 17 at the approximately constant distance (about 0.05 mm) from all the slits 19. Therefore, the propagation of a fluctuation in pressure (so-called crosstalk) can be prevented between a part of the discharge channels 23A and the dummy channels 23B which are adjacent to each other. As a result, discharge characteristics of all the discharge channels 23A are substantially stabilized. Thus, the ink is discharged from all the discharge channels 23A without being affected by an operating state of the adjacent dummy channels 23B. For example, a difference in ink discharge speed from each of the discharge nozzle holes 27 is kept to about 0.2 m/s or less, whereas a difference in amount of discharged ink is kept within ±3%.

As described above, according to the liquid-jet head chip 1, the liquid-jet head 10, and the liquid-jet recording apparatus 100 of this embodiment, the air vent flow paths 71A and 71B, each including the filter 73 for allowing passage of air bubbles, expel the air bubbles accumulated on the foreign substance removal filter 29 to the exterior to prevent the supply of the ink to the common ink chamber 17 from being disrupted and to maintain the negative pressure in the common ink chamber 17. As a result, the ink can be stably discharged, thereby performing stable printing on the recording medium S. Moreover, it is unnecessary to provide the foreign substance removal filter 29 and the air vent flow paths 71A and 71B in the flow path 9 or in an additional separate component. Thus, the structure of the liquid-jet head chip 1 and that of the liquid-jet head 10 can be simplified. Therefore, the size, the thickness, and the manufacturing cost of the liquid-jet head 10 can also be reduced.

Figure 6:
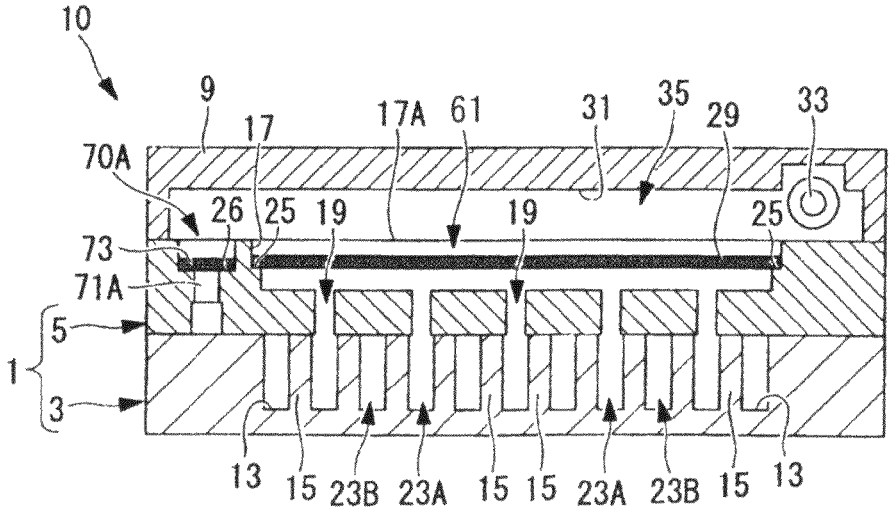
FIG. 6 is a sectional view of the liquid-jet head according to a modification of the embodiment of the present invention.

Although the ink introduction hole 33 is provided in the vicinity of the approximate longitudinal center of the common flow path 35 in this embodiment, the ink introduction hole 33 may be provided, for example, at a position adjacent to any one of the longitudinal ends of the common flow path 35 as illustrated in FIG. 6. In this case, the air bubbles entering the common flow path 35 from the ink introduction hole 33 are likely to be accumulated in a direction away from the ink introduction hole 33, that is, at the other longitudinal end of the common flow path 35. Thus, it is sufficient to provide the air vent flow path 71A alone at a position adjacent to the longitudinal end of the common ink chamber 17, which is on the side distant from the ink introduction hole 33, without providing the air vent flow path 71B. In this manner, the structure of the liquid-jet head chip 1 can be further simplified.

Moreover, although the foreign substance removal filter 29 has been exemplified for description in this embodiment, any structure having a flat surface, which can be located at an approximately constant distance from the ends of all the slits 19, may be used instead. For example, a plate having a through-hole may be used. In this case, it is preferred to locate the structure at a distance less than 0.8 mm from the ends of all the slits 19.

Further, the discharge channels 23A and the dummy channels 23B are alternately formed in the direction in which the discharge grooves 13 are arranged in this embodiment. Instead, however, the slits 19 of the cover plate substrate 5 may be brought into communication with all the discharge grooves 13 to form only the discharge channels 23A. In this case, the nozzle holes 27 may be formed through the nozzle plate 7 at intervals so as to be opposed to all the discharge channels 23A. In this manner, the ink can be discharged from each of all the discharge channels 23A without being affected by the operation of the other discharge channels 23A.

Further, in this embodiment, there has been described the driving method for setting the voltage applied to the side walls 15 to zero to bring both the side walls 15 of the discharge channel 23A into a state without deformation before the application of the voltage. However, the voltage may be applied in the opposite direction. Specifically, the voltage may be applied in the other direction perpendicular to the polarization direction to inwardly deform both the side walls 15 of the discharge channel 23A, that is, to deform both the side walls 15 away from the dummy channels 23B. In this manner, the volume of the discharge channel 23A is reduced to increase the pressure, whereby the ink is discharged from the nozzle holes 27.

The different driving method has also been described as above. In the above-mentioned methods, when the ink is required to be further pressurized to stably discharge the ink, the side walls 15 are deformed to project toward the discharge channels from which the ink is discharged. An internal pressure of the discharge channels, from which the ink is discharged, is further increased by this operation, and hence the ink can be further pressurized. However, the operation is performed for the purpose of stably discharging the ink as described above, and hence the operation is not essential. Therefore, the operation may be arbitrarily used as needed. Moreover, by performing the operations described above in combination as needed, the optimal discharge of the ink can be realized.

Further, although the ink-jet recording apparatus has been described as an example of the liquid-jet recording apparatus in this embodiment, the liquid-jet recording apparatus is not limited to the printer. For example, the liquid-jet recording apparatus of the present invention may include a fax, an on-demand printer, or the like. Moreover, although the plurality of nozzle holes 27 are linearly arranged in one row in the direction of arrangement, the plurality of nozzle holes 27 may be arranged to be shifted from each other in a longitudinal direction. For example, the plurality of nozzle holes 27 may be arranged obliquely or in a zigzag pattern. Moreover, the shape of each of the nozzle holes 27 is not limited to a circle. For example, the shape of each of the nozzle holes 27 may include an ellipsoid, a star-like shape or a polygon such as a triangle.

Although the case where the water-based ink is used has been described in this embodiment, a non-conductive oil-based ink, a solvent ink, a UV-ink, or the like may be used. When the oil-based ink is used, it is sufficient to provide the liquid-jet head chip 1 with the above-mentioned structure including the discharge channels 23A alone. Specifically, the slits 19 of the cover plate substrate 5 are brought into communication with all the discharge grooves 13 to form the discharge channels 23A alone. By thus configuring the liquid-jet head chip, any type of ink may be used. Therefore, the water-based ink can be used to perform recording. In particular, even the ink having conductivity can be used without any problems, and hence the added value of the ink-jet printer can be enhanced. For the rest, similar functions and effects can be obtained.

Although the cover plate opening portion 61 of the cover plate substrate 5 includes the common ink chamber 17 and the slits 19 in this embodiment, the cover plate opening portion 61 may be in communication with all the discharge grooves 13 without including the slits 19, for example. In this manner, for example, when the oil-based ink is used, the configuration of the liquid-jet head chip 1 can be simplified.

Moreover, although the common ink chamber 17 is formed in the cover plate substrate 5 in this embodiment, the common ink chamber may be formed in the actuator substrate 3 as a reference example. For example, the following structure may be alternatively used. In this alternative structure, the common ink chamber with a U-shaped cross section, extending in the direction in which the discharge grooves 13 are arranged, and the air vent flow path independent of the common ink chamber are formed on a rear surface of the actuator substrate 3 (on the surface of the actuator substrate 3, which is on the side opposite to the surface on which the discharge grooves 13 are formed). On a bottom surface of the common ink chamber, the slits in communication with the discharge grooves are formed. In this case, the position of the support plate is changed. Specifically, the support plate is arranged to be superimposed on the cover plate substrate 5.

What is claimed is:

1. A liquid-jet head chip, comprising:

an actuator substrate comprising a plurality of liquid discharge flow paths, the plurality of liquid discharge flow paths each being open on one surface of the actuator substrate, the plurality of liquid discharge flow paths being formed in parallel at a distance from each other;

a cover plate substrate bonded onto the one surface of the actuator substrate;

the cover plate substrate comprising:

an opening portion being open on a surface of the cover plate substrate on a side opposite to the actuator substrate and being in communication with the liquid discharge flow paths; and an air vent flow path for bringing the surface on which the opening portion is open and an end surface extending in a thickness direction of the cover plate substrate into communication with each other, the opening portion and the air vent flow path being provided independently of each other;

a foreign substance removal filter for removing a foreign substance provided at a position at which the opening portion of the cover plate substrate is substantially closed; and a filter for allowing passage of air bubbles, having a smaller passage resistance than that of the foreign substance removal filter, provided at a position at which an opening of the air vent flow path is substantially closed.

2. A liquid-jet head chip according to claim 1, wherein the opening portion comprises:

a concave portion having an aperture plane on the surface on the side opposite to the actuator substrate; and a plurality of through-holes extending from the concave portion to the liquid discharge flow paths.

3. A liquid-jet head chip according to claim 2, wherein the air vent flow path is open in a direction along the liquid discharge flow paths.

4. A liquid-jet head, comprising:

the liquid-jet head chip according to claim 3; and a flow path member bonded onto the surface of the cover plate substrate, on which the opening portion is open, the flow path member comprising a flow path being in communication with the opening portion and the air vent flow path.

5. A liquid-jet recording apparatus comprising the liquid-jet head according to claim 4.

6. A liquid-jet head chip according to claim 1, wherein the air vent flow path is open in a direction along the liquid discharge flow paths.

7. A liquid-jet head, comprising:

the liquid-jet head chip according to claim 6; and a flow path member bonded onto the surface of the cover plate substrate, on which the opening portion is open, the flow path member comprising a flow path being in communication with the opening portion and the air vent flow path.

8. A liquid-jet recording apparatus comprising the liquid-jet head according to claim 7.

9. A liquid-jet head, comprising:

the liquid-jet head chip according to claim 1; and a flow path member bonded onto the surface of the cover plate substrate, on which the opening portion is open, the flow path member comprising a flow path being in communication with the opening portion and the air vent flow path.

10. A liquid-jet recording apparatus comprising the liquid-jet head according to claim 9.

* * * * *